United States Patent [19]

Duncan et al.

[11] Patent Number: 4,735,018

[45] Date of Patent: Apr. 5, 1988

[54] GATE OPERATOR UNIT

[76] Inventors: William B. Duncan; Richard J. Loos, both of 445 Sunset Rd., San Antonio, Tex. 78209

[21] Appl. No.: 54,578

[22] Filed: May 27, 1987

[51] Int. Cl.[4] ..... E05F 11/24

[52] U.S. Cl. ..... 49/340; 49/139; 49/344; 49/345

[58] Field of Search ..... 49/359, 358, 340, 345, 49/344, 140, 139

[56] References Cited

U.S. PATENT DOCUMENTS

| | | | |
|---|---|---|---|
| 649,794 | 5/1900 | Ashby | 49/357 |
| 2,592,891 | 4/1952 | Hall | 268/65 |
| 4,416,085 | 11/1983 | Lybecker et al. | 49/340 |
| 4,429,491 | 2/1984 | Bruns | 49/340 |
| 4,638,597 | 1/1987 | Lybecker | 49/340 |

*Primary Examiner*—Philip C. Kannan

[57] ABSTRACT

An automatic gate opening device consisting of two arm members pivotally attached to form a link. One end of the link is pivotally attached to one end of a standoff. The second end of the standoff is fixedly attached to a hinge post supporting the gate. The second end of the link is pivotally attached to the gate. An electrically powered linear actuator is pivotally attached to the post arm and gate arm through levers. The solar panel charges a battery which, through a receiver unit, powers the actuator. Gate operator actuates gate with a portable transmitter.

18 Claims, 3 Drawing Sheets

GATE OPERATOR UNIT

BACKGROUND OF THE INVENTION

1. Field of the Invention

The present invention relates generally to the art of power operated gates, more particularly to a novel powered mechanism using a combination of levers together with a linear actuator for operating the gate.

2. Description of the Prior Art

In the west and southwest, there are large, remote regions fenced in, thereby necessitating numerous gates to pass through. It is annoying and inconvenient to stop and manually operate each gate. Additionally, commercial electrical energy is usually not available in these remote regions.

Heretofore, many power actuated gates have been developed. Power actuators for closures such as gates, doors, and the like have been formally proposed; however, their complex construction and low reliability has restricted their use. These gates or gate opening devices have used hydraulic or mechanical linear actuators combined with mechanical linkage.

For example, Lybecker, U.S. Pat. No. 4,638,597 discloses a gate apparatus mounting the linkage and actuator on a multi-member frame. A solar panel is used to supply power to a storage battery. A control unit manually or remotely actuates a motor switch, which drives a bidirectional gear pump, allowing the linear actuator to reverse direction. Lybecker also features a pivot point remote from the gate hinge post with a stationary linear actuator connected to one arm of the pivoting linkage.

Bomar, U.S. Pat. No. 3,500,585 discloses an electric motor unit having a ram or actuator unit capable of extension and retraction. The ram is pivotally attached to the ground at a support post removed from the gate and hinge post. One end of the ram is attached to the gate, and the other end of the ram is pivotally mounted to the support post. The extension and retraction of the ram moves the gate ninety (90°) degrees from between an open and a closed position and also latches and unlatches the gate. However, Bomar does not use a pivoting linkage to operate the gate.

The electrical gate opening devices of the prior art requires a relatively high amount of energy to operate. In addition, the apparatus is bulky and, with the gate in certain positions, can actually impede the progress of a vehicle. These disadvantages, among others, are addressed by the present invention's unique system of levers and hinge points, with the linear actuator positioned to rotate with the gate.

SUMMARY OF THE INVENTION

The automatic gate opening device which is the subject of this invention has two arms which are pivotally attached to form an articulated linkage. A mechanical or hydraulic linear actuator which consists of a gear-driven, extending and retracting ram and barrel is pivotally attached through rigid levers to each arm of the pivoting linkage. The entire linkage, with linear actuator, power supply and control box attached, is mounted to the gate through a pivotal attachment at one end of the linkage, with a second end of the linkage connected to a standoff attached to the hinge post of the gate.

A battery power pack system contains a rechargeable battery, a solar cell to recharge the battery, a radio wave receiver, and an electronic control board. The gate opening device may be actuated by a battery-powered radio wave transmitter or through a manual switch.

The invention employs five members (levers) with a specific location and relation among five hinge points connecting them together. Each hinge point is located at a critical distance and angle to the other. The design allows for maximum mechanical efficiency and permits a relatively small force to operate a swinging gate of any length, especially when motion is initiated and before angular momentum is acquired.

It is the object of the present invention to provide an automatic gate opening device that may be used in locations where commercial electricity is not economically available.

It is still another object of the present invention to provide a gate opener with a gear-driven, linear actuator operating a pivotal linkage to open or close a gate, the pivotal linkage having five pivot points.

It is yet another object of the present invention to provide a linear actuator which is mounted on the pivoting linkage and moves along with it.

It is yet another object of the present invention to provide a linear actuator whose mechanical gears will load when the gate reaches an open position against a stop post.

It is a further object of the present invention for the pivotal linkage to lock the gate in an open or a closed position until the power supply is actuated.

It is yet another object of the present invention to provide for electronic controls that operate the linear actuator through manual or radio-transmitted means.

It is yet another object of the present invention to provide a solar powered gate opener that may be used at remote locations, whose linear actuator operates efficiently and draws little electricity.

It is yet another object of this invention to allow for human error involved in installation, yet still maintain a full gate opening and closure of 90°.

It is yet another object of this invention to adjust gate pressure against a stop post in such a manner that the linear actuator gear drive mechanism disengages prior to overloading and overheating as the gate moves against the stop post.

DESCRIPTION OF THE PREFERRED EMBODIMENT

Figure 1:
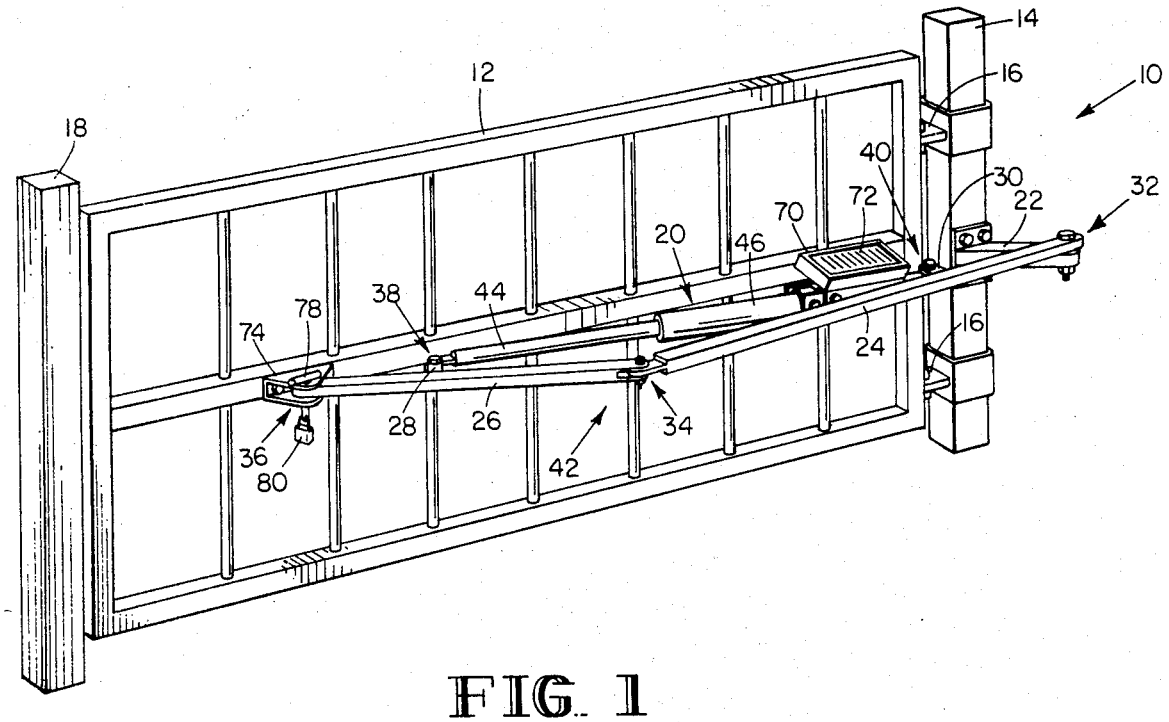
FIG. 1 is a perspective view of the gate structure in closed condition.

FIG. 1 illustrates the main components of gate operator unit ("unit") 10. Gate 12 articulates at hinge post 14 on hinges 16. Hinges 16 support gate 12 and allow gate 12 to swing freely approximately 90° from a closed position with gate 12 against stop post 18 to an open position. Gate 12 in an open position will allow the passage of vehicular traffic, in a closed position will prevent such passage.

Gate operator unit 10 consists of an interconnected system of five levers and linear actuator 20. The five levers act through five pivot or hinge points. The structure and function of the five lever/five hinge point system is set out more fully below.

Referring to FIG. 1, the five levers are: standoff 22, post arm 24, gate arm 26, gate arm lever 28, and post arm lever 30. For the sake of brevity, the hinge or pivot points will be described by their respective numbers. Standoff 22-post arm 24 hinge point will be referred to as hinge point 32, post arm 24-gate arm 26 hinge point will be referred to as hinge point 34, gate arm 26-gate 12 hinge point will be referred to as hinge point 36, gate arm lever 28-linear actuator 20 hinge point will be referred to as hinge point 38, and post arm lever 30-linear actuator 20 hinge point will be referred to as hinge point 40. All five levers and hinge points lay in the same plane that plane being perpendicular to the plane of gate 12.

Figure 3:
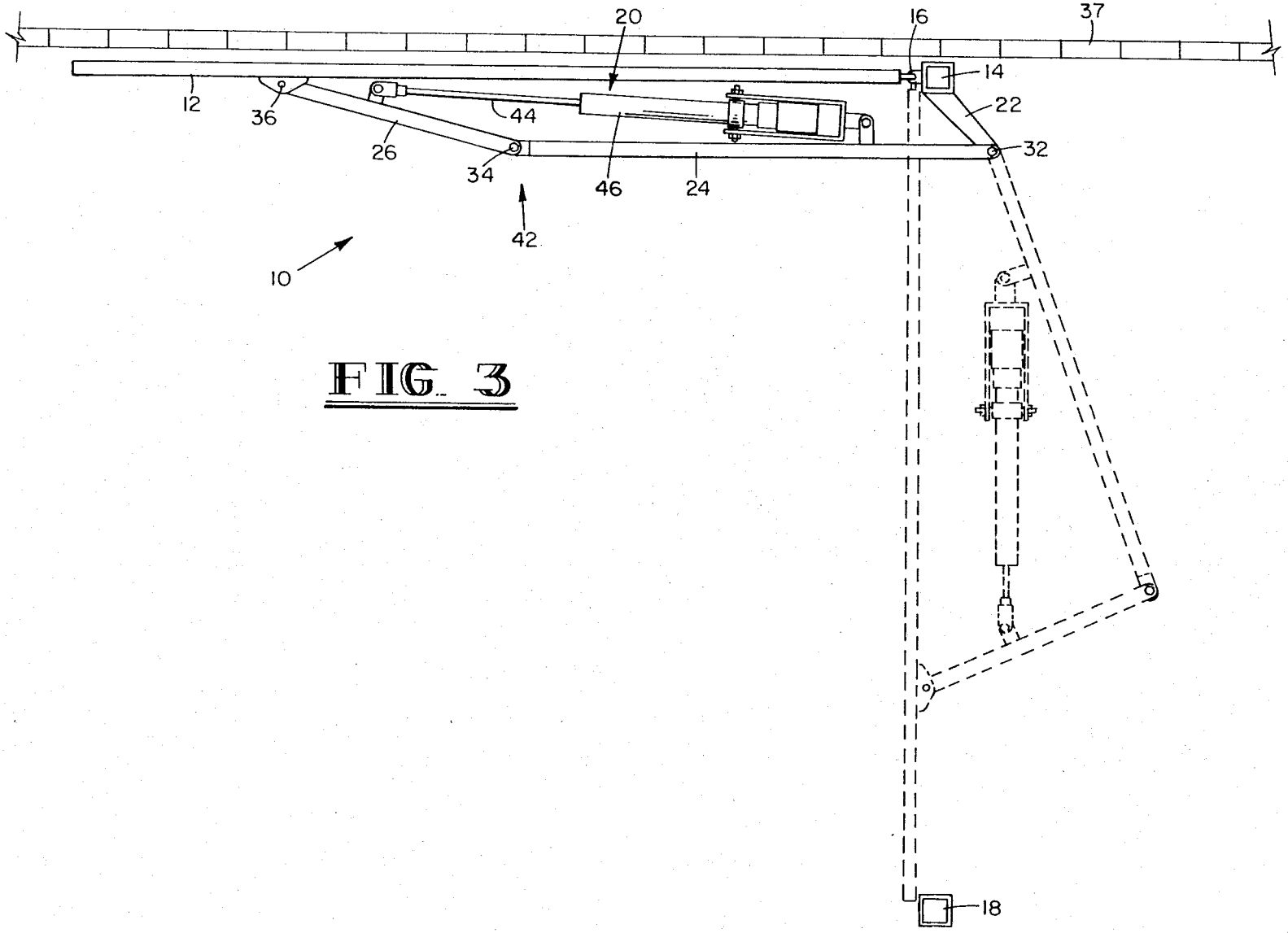
FIG. 3 is an alternate embodiment of the device to be used, when the gate, in an open position, lies against an obstruction.

As can be seen in FIG. 1, standoff 12 is rigidly mounted to hinge post 14. For proper operation of gate operator unit 10, standoff 22 should extend outward from hinge post 14 at an angle of approximately 147½° from a closed position of gate 12. The length of standoff 22 from axis of rotation of gate 12 to hinge point 32 should be 16.4 inches (for up to 14 foot gates) or 21.8 inches (for gates from 14 foot up to 20 foot) for the most efficient operation. Gate 12 distance is measured from an axis connecting hinges 16 to the far end of gate 12. Use of standoff 22 is advantageous because it allows the use of a shorter gate arm 26 and post arm 24, while at the same time keeping the entire system of levers physically close to plane of gate 12 when gate is "closed" as illustrated in FIG. 1 or "open" as illustrated in FIG. 3.

Gate arm 26 and post arm 24 are connected at hinge point 34 to form actuator link ("link") 42. Link 42 is connected at hinge point 32 to standoff 22, and at hinge point 36 to gate 12. Linear actuator 20 operates actuator link 42 through gate arm lever 28 and post arm lever 30. That is, linear actuator 20 can expand and contract its length through the extension of ram 44 from tube 46. Linear actuator 20 may be either hydraulic or mechanical (gear driven). In the preferred embodiment, linear actuator 20 is mechanical. One source of mechanical linear actuators is Warner Electric Brake and Clutch Company, 1300 North State St., Marengo, Ill. 60152.

For gates up to 14 foot, the relevant preferred lengths of the levers (as measured from hinge points) are: standoff 22, approximately 16.4 inches; post arm 24 approximately 42⅞ inches total length, with approximately 6⅜ inches from hinge point 32 to post arm lever 30; gate arm 26 approximately 49½ inches total length, with approximately 19½ inches from hinge point 36 to gate arm lever 28; post arm lever approximately 3 inches long and gate arm lever approximately 1⅝ inch long. On an up to 14-foot gate, the linear distance from a longitudinal axis extending through hinges 16 to hinge point 36 is approximately 71 inches.

For gates over 14 foot up to and including 20 foot, the relevant preferred lengths are as follows: standoff 22 approximately 21.8 inches; post arm 24 approximately 49⅛ inches total length, with approximately 16½ inches from hinge point 32 to post arm lever 30; gate arm 26 approximately 68½ inches total length, with approximately 19½ inches from hinge point 36 to gate arm lever 28; post arm lever approximately 3½ inches long and gate arm lever approximately 2 inches long. Linear actuator 20 will expand and contract through a distance of 20 inches in both the up to 14 foot and the over 14 foot and up to 20 foot model gates 12. On the larger gate 12, the linear distance from a longitudinal axis extending through hinges 16 to hinge point 36 is approximately 97½ inches.

FIG. 1 illustrates the manner in which the system of levers and hinge points allows hinge point 36, which represents the point at which torque is applied to rotate gate 12, to be located towards the far end of gate 12. This is advantageous because for any force (F) applied with at least a component of F being normal to the plane of gate 12, the torque resulting from F is directly proportional to the distance between the axis of rotation of gate 12 and the point of application of F.

These dimensions will allow gate 12 to rotate 90 degrees when the length of linear actuator 20 changes 20 inches (except on the reverse embodiment illustrated in FIG. 3 and described more fully below). Changing the length of any of the five levers will change the 90-degree figure unless the lengths of the other levers are changed proportionally. If the dimensional ratios among the five levers remain the same, their lengths may be changed but a 90° opening will remain for a 20-inch change in length of linear actuator 20.

FIG. 1 illustrates gate 12 in a closed position. In operation, ram 44 begins to withdraw into tube 46 as linear actuator 20 begins opening gate 12. When this occurs, the angle transcribed by actuator link 42 begins to decrease. At the same time, actuator link 42 pivots on standoff 22. When gate 12 is in an open position, actuator link 42 transcribes a smaller angle than when closed. In the preferred embodiment, movement of ram 44 through a 20 inch range is sufficient to move gate 12 ninety degrees (90°) between an open and a closed position. In an alternate embodiment standoff 22 may be replaced by a post in the ground, located in the same relative position as hinge point 32 is with respect to hinge post 14.

Figure 2:
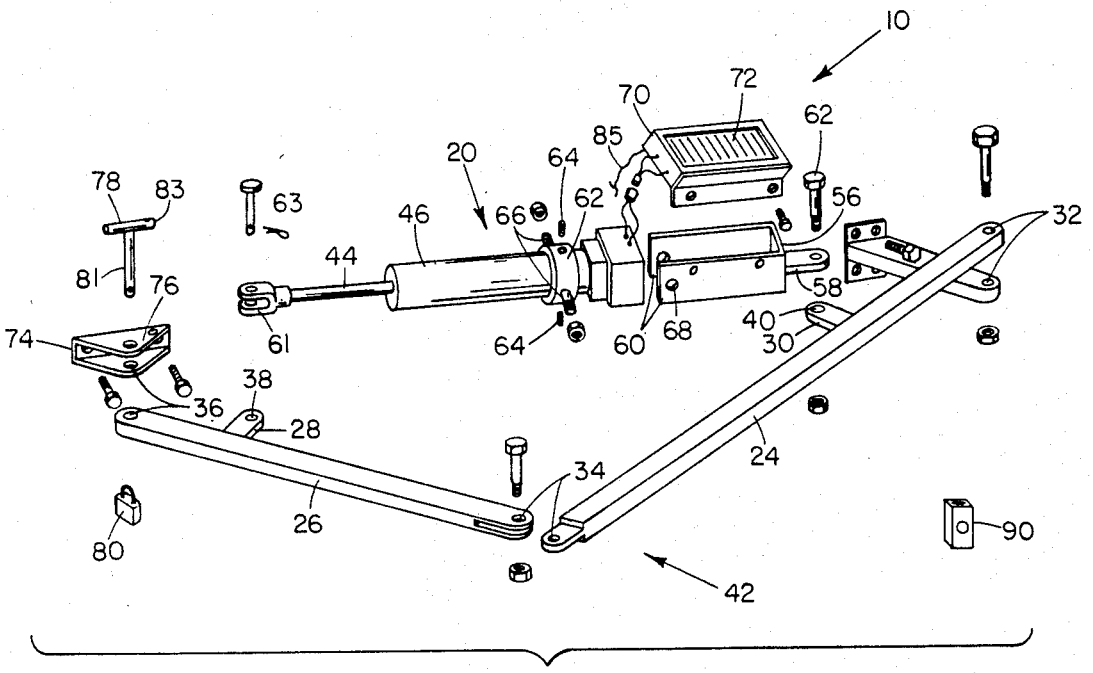
FIG. 2 is an exploded view of the gate operator structure.

FIG. 2 illustrates the arrangement of linear actuator 20, actuator link 42, gate arm 26 and post arm 24. In addition, FIG. 2 illustrates the components of linear actuator 20 and how it attaches to post arm 24 and gate arm 26. To attach linear actuator 20, fork 56 is used. Fork 56 consists of "T" shaped mounting member 58 with bolt holes drilled therethrough, and two prongs 60 extend from mounting member 58. Mounting member 58 is attached to post arm lever 30 by actuator mounting bolt 62 passing through both mounting member 58 and post arm lever 30. Prongs 60 are spaced a sufficient distance apart to carry between them cylindrically shaped barrel 46 of linear actuator 20.

Collar 62 is annular and adapted to slide over and fit snugly against barrel 46. Collar 62 contains several set screws 64 to allow positioning of collar 62 along barrel 46. During assembly of gate operator unit 10, collar 62 is positioned along barrel 46 and fixed in place with set screws 64. That is, by moving barrel 46 with respect to collar 62, the number of degrees gate 12 moves between open and closed position may be adjusted. During assembly of unit 10, assembler can adjust collar 62/barrel 46 position until gate 12 contacts stop post 18 just before linear actuator 20 stops its extension. Careful assembly and adjustment will insure that linear actuator 20 will maintain pressure against stop post 18 after gate 12 has reached a closed position.

Collar 62 attached to fixed prongs 60 at swivel prongs 66. Swivel prongs 66 will allow the attachment of collar 62 and linear actuator 20 through actuator mount holes 68. When linear actuator 20 is mounted to fork 56 and set in place, actuator mount hole 68 and swivel prongs 66 lay in a plane formed by actuator link 42. An axis formed by a line drawn between actuator mount hole 68 on fixed prong 60 lies in a plane formed by actuator link 20. By mounting actuator 20 in this manner, sagging of gate 12, which would result in distorting plane of actuator link 42 from two dimensions to three dimensions, would not cause a twist in linear actuator 20. That is, when gate 12 sags, as gates invariably do, twisting of the plane of actuator link 42 into a curved surface will not bend linear actuator 20 as it is free to articulate through swivel prongs 66 at actuator mount hole 68. This feature helps prolong the life of linear actuator 20, by avoiding the internal transmission of strain, stess and tension forces to the internal gears of linear actuator 20. Linear actuator 20 is attached through ram 44 to gate arm lever 28 by suitable means, such as "Y" fork 61 and clevis pin 63. This description completes the connection of linear actuator 20 to actuator link 42.

In the preferred embodiment, solar panel module 70 is mounted to fork 56 at prongs 60. Solar cell 72 of solar panel module 70 is adjusted for maximum exposure to the sun and contains at least one cell. In the northern hemisphere, solar cell 72 will normally have a southern exposure. Electrical energy generated by solar panel module 70 is stored in suitable batteries contained therein.

Figure 4:
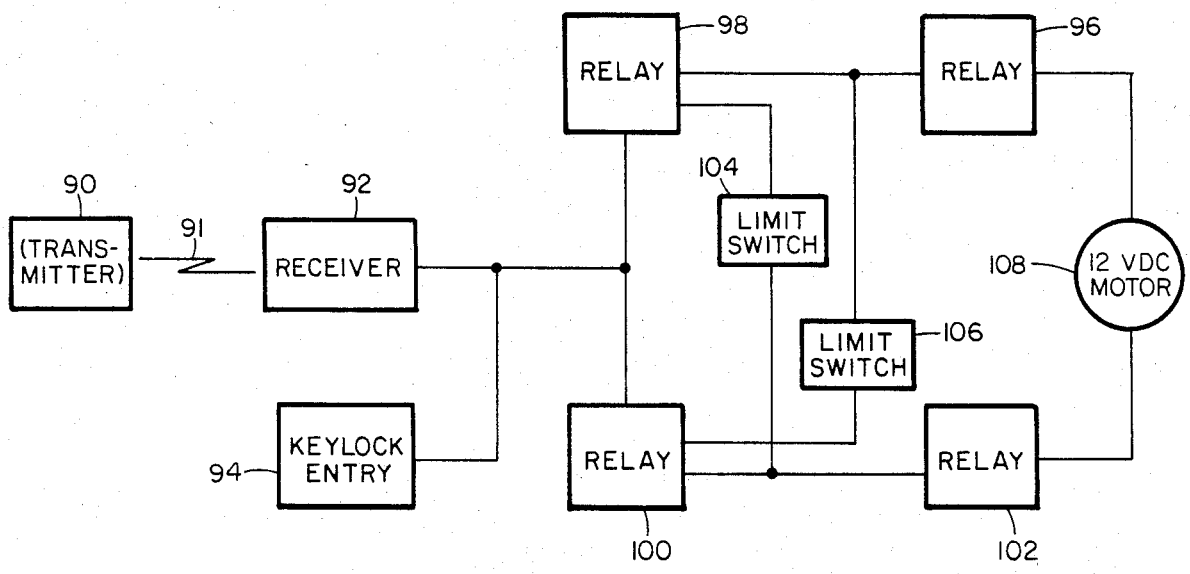
FIG. 4 is block diagram showing the manner in which the electrical signals initiate movement of the gate.

Contained within solar panel module 70 is receiver 92 (FIG. 4). Receiver 92 is designed to detect frequencies emitted by portable, hand-held transmitter 90 used to actuate unit 10. This allows user to activate unit 10 without getting out of a vehicle or dismounting from a horse. Transmitter 90 and receiver 92 are commercially available and are often used on automatic garage door openers. One source of these items is Mutli-Elmac, located at 22700 Heslip Drive, Novi, Mich. 48050. Antenna 85 for receiver 92 may be a wire hung from solar panel module 70.

FIG. 2 also illustrates the manner in which gate arm 26 is attached to gate 12 with gate attach bracket 74. Gate attach bracket 74 has protruding ears 76 which slide over free end of gate arm 26. When this occurs, bolt holes in ears 76 can align with bolt holes drilled through free end of gate arm 26 and T-handle bolt 78 can be inserted therethrough to secure actuator link 42 to gate 12. T-handle bolt 78 contains a lock 80 through far end 81 of T-handle bolt 78 or handle 83 of T-handle bolt 78. By removing lock 80, T-handle bolt 78 can be withdrawn through ears 76, allowing gate arm 26 to swing freely away from gate 12, pivoting at pivot point 32. Gate 12 can then be opened. This provides for an emergency backup and an alternate means of opening gate 12. By using lock 80, unauthorized removal of gate arm 26 and opening of gate 12 is prevented.

FIG. 3 illustrates an alternate "reverse" embodiment of unit 10 to be used when gate 12 in an open position lies against obstruction 37, such as a wall or a fence. In this embodiment actuator link 42 transcribes a larger angle when gate 12 is in an open position than when gate 12 is closed. When mounting actuator link 42 to gate 12 in this alternate embodiment, standoff 22 is mounted to hinge post 14 to transcribe an angle of approximately 52½° degrees between the longitudinal axis of standoff 22 and plane of gate 12 when gate 12 is in a closed position. Other dimensions as described above for length and location of levers are the same. However, linear actuator 20 need only move through a distance of approximately 13¼ inches to move gate 12 through 90 degrees between an open and a closed position.

FIG. 4 illustrates the manner in which electrical signals from transmitter 90 or key lock entry 94 initiate movement of gate 12. Remote transmitter 90 transmits a coded electromagnetic pulse train 91 to receiver 92. In the preferred embodiment, transmitter 90 is of the type commercially available and used for garage door openers. The remote transmitter has a carrier frequency of 303 megahertz. By coding a carrier frequency with a number of different codes (frequencies), one individual's transmitter 90 will not activiate another individual's receiver 92. In addition to activating system through receiver 92, key lock entry 94 containing a manual switch may be used. This allows individuals that have the proper key, but do not have transmitter 90 to operate gate 12.

Upon activation of system either by receiver 92 or key lock entry 94, linear actuator 20 will either begin to retract (if gate is in a closed position) or extend (if gate is in an open position).

If gate 12 is closed, upon activation relay 102 will be energized through retract limit switch 104, which is closed when gate 12 is in a closed position. In addition, relay 100 is energized to close the circuit until opened by extend limit switch 106. If the gate is open, relay 96 is energized through extend limit switch 106, and relay 98 is energized to close the circuit until opened by retract limit switch 104.

In this manner, current through actuator motor 108, which is preferrably located in linear actuator 20, is reversed, changing linear actuator 20 from extension to retraction or retraction to extension.

A 12-volt DC battery source is charged by solar cell 72 of solar panel module 70, and is contained within solar module 70. The use of a blocking diode to prevent the battery from discharging at night is not required if solar cell 72 has low reverse current characteristics. In an alternate embodiment, the power source for unit 10 is commercially available A-C electricity.

The lever and hinge point arrangement described above, in conjunction with linear actuator 20, has been found through testing to provide a maximum mechanical efficiency for opening and closing gate 12. Linear actuator 20 should be adjusted to "unload" or disengage when gate 12 is against stop post 18. When the mechanical gears of linear actuator 20 disengage, ram 44 continues to extend under momentum of gate 12. Momentum of gate 12 urges it against stop post 18. Linear actuator 20 has some backlash, or slack, that is "stored" in its gears. Therefore, as gate 12 expends its energy against stop post 18, a slight flexing, or loading, of the levers in the system occurs. That is, the absorption and rebound of stop post 18 against gate 12 results in force stored as potential energy under slight flexing of levers of unit 10. Through the use of the five levers/five hinge point system of unit 10, loading or rebound forces are more effectively transmitted to linear actuator 20 such that upon opening of gate, this potential energy is expended, assisting the gears of linear actuator 20 to withdraw ram 44 into barrel 46. This is especially critical because, at the instant that gate 12 begins to open, the inertia of the mass of gate 12 needs to be overcome. In other designs, a large amount of energy is required to initiate movement of gate 12. This is a disadvantage because of the limited energy available from the power supply. It is incumbent upon self-contained, solar-operated gate 12, that as little electrical energy be expended in each operation of gate 12 as possible.

It is the unique system of five levers and five hinge points that allow a minimum energy drain at a time in the operation cycle when most designs draw most of their electrical energy. Tests performed by inventors reveal that other arrangements require about 9 amps to initiate gate 12 movement. Under otherwise identical conditions and gate design, the unique arrangement of levers disclosed drew only 7 amps to initiate movement of gate 12.

It is also an advantage of unit 10 to carry linear actuator 20 on rotating actuator link 42. This design, combined with standoff 22, allows an arrangement of the major components of unit 10 such that when gate 12 is in a closed position as illustrated in FIG. 1, or an open position as illustrated in FIG. 3, the arrangement lies almost flush against gate 12. For example, in FIG. 3 it can be seen that if the main components of a gate operator unit did not lie in close proximity to gate 12, they could interfere with the passage of a vehicle along a driveway. Unit 10 is designed to bring main components within close proximity to gate 12 as illustrated in FIG. 3. Specifically, the longitudinal axes of both gate arm 26 and post arm 24 should be at angles of less than 40° with respect to plane of gate 12 when gate is closed as illustrated in FIG. 1 or open as illustrated in FIG. 3.

An additional advantage of using unit 10 is that it can use a shorter linear actuator 20. Specifically, gate arm lever 28 and post arm lever 30 allow a shorter linear actuator 20 to be used for any given distance from hinge point 34. When a longer actuator 20 is used, greater flex of ram 44 is likely. This leads to complications, such as excess wear or misalignment in the internal gear system with barrel 46.

Unit 10 disclosed and claimed is the preferred embodiment. However, many alternate embodiments would be obvious to one of ordinary skill in the art. It is the express intention of applicant that such obvious alternate embodiments as disclosed fall within the scope of the claims.

I claim:

1. A device for automatically opening and closing a gate comprising:

an actuator link including a first arm and a second arm, said arms each having a first and a second end, said first ends being pivotally attached together;

a standoff having a first end and a second end, said standoff rigidly attached at said first end to a hinge post of said gate, said second end being removed from said hinge post;

arm lever means rigidly attached to either said first arm or said second arm and extending inwardly toward said gate;

a linear actuator having a first end and a second end and capable of increasing and decreasing in length;

power means for operating said linear actuator, said power means connected to said linear actuator; and means for activating said power means;

wherein said first end of said linear actuator is connected to said arm lever means and said second end of said linear actuator is attached to either said first arm or said second arm, said arm lever means increasing mechanical advantage of said linear actuator, said linear actuator thereby capable of pivoting said actuator link, and, having said second end of said first arm attached to said second end of said standoff and said second end of said second arm attached to said gate, the pivoting thereby moving said gate between an open position and a closed position.

2. A device for automatically opening and closing a gate comprising:

an actuator link including a first arm and a second arm, said arms each having a first and a second end, said first ends being pivotally attached;

a standoff having a first end and a second end, said standoff rigidly attached at said first end to a hinge post of said gate, said second end being removed from said hinge post;

a first arm lever with a first end rigidly attached to said first arm and a second end removed therefrom;

a second arm lever with a first end rigidly attached to said second arm and a second end removed thereform; and a linear actuator having a first end and a second end and capable of increasing and decreasing in length;

power means for operating said linear actuator, said power means connected to said linear actuator;

means for activating said power means;

wherein said first end of said linear actuator is connected to said second end of said first arm lever, and said second end of said linear actuator is attached to said second end of said second arm lever, said linear actuator thereby capable of pivoting said actuator link, and, having said second end of said first arm attached to said standoff and said second end of said second arm attached to said gate, the pivoting thereby moving said gate between an open position and a closed position.

3. A device for automatically opening and closing a gate as described in claim 2 wherein said power supply comprises a direct current battery and a solar cell for recharging of said battery during daylight hours.

4. A device for automatically opening and closing a gate as described in claim 3 wherein said activating means includes a means for receiving a radio wave from a transmitter for remote operation of gate.

5. A device for automatically opening and closing a gate as described in claim 3 wherein said activating means includes a switch for manual operation of gate.

6. A device for automatically opening and closing a gate as described in claim 5 including a key means for overriding said switch and preventing the manual operation of said gate.

7. A device for automatically opening and closing a gate as described in claim 2 wherein said linear actuator lies in a plane formed by said actuator link.

8. A device for automatically opening and closing a gate as described in claim 2 wherein said actuator link contains an electronic control board therein for engaging and disengaging a drive means, said drive means for extending and contracting a length of said linear actuator.

9. A device for automatically opening and closing a gate as described in claim 8 wherein said length of said linear actuator changes by approximately twenty (20) inches, said change moving said gate approximately ninety (90°) degrees between said open and said closed positions.

10. A device for automatically opening and closing a gate as described in claim 2 further comprising a quick release means for disengaging said actuator link from said gate without activating said power means, thereby allowing said gate to be manually moved between said open and said closed positions.

11. A device for automatically opening and closing a gate as described in claim 10 wherein said quick release means includes a T-handle bolt and a gate connect bracket for securing said second end of said second arm to said gate, said T-handle bolt removably insertable through said gate connect bracket and said second end of said second arm, securing said actuator link to said gate thereby.

12. A device for automatically opening and closing a gate as described in claim 11 further comprising a lock means removably attached to said T-handle bolt at an end removed from a T-handle end of said T-handle bolt, thereby securing said T-handle bolt to said gate connect bracket.

13. A device for automatically opening and closing a gate as described in claim 2 wherein said first arm lever and said second arm lever lie substantially within the plane of said actuator link and said first and second arm levers extend substantially perpendicular to said first and second arms of said actuator link, respectively.

14. A device for automatically opening and closing a gate as described in claim 2 wherein said first and said second arms of said actuator link form an obtuse angle enclosing said linear actuator therein when said gate is in said closed position and with the longitudinal axis of said linear actuator lying substantially parallel to said gate; and wherein said first and said second arms of said actuator link form an acute angle when said gate is in said open position.

15. A device for automatically opening and closing a gate as described in claim 2 wherein said first and second arms of said actuator link form an obtuse angle enclosing said linear actuator therein when said gate is in said open position and with the longitudinal axis of said linear actuator lying substantially parallel to said gate; and said first and second arms of said actuator link forming an acute angle when said gate is in said closed position.

16. A device for automatically opening and closing a gate as described in claim 2 further comprising means for adjusting the number of degrees transcribed by said gate when moving between said open and said closed positions.

17. A device for automatically opening and closing a gate as described in claim 16 wherein said adjusting means includes a collar and fork, said collar being adjustably attached to said linear actuator and to said fork, with said fork being mounted to said second end of said first arm lever, said adjustable attachment thereby determining the number of degrees transcribed by said gate when moving between said open and said closed positions.

18. A device for automatically opening and closing a gate, comprising:

an actuator link including a post arm and a gate arm each with a first and a second end, with said first ends of said post arm and said gate arm pivotally attached;

a linear actuator having a first and a second end, said linear actuator capable of expanding and contracting in length;

a gate arm lever with a first and a second end, rigidly attached at said first end to said gate arm, said gate arm lever extending substantially perpendicular to said gate arm, and with said second end of said gate arm lever pivotally attached to said first end of said linear actuator;

a post arm lever with a first and second end, rigidly attached at said first end to said post arm, said post arm lever extending substantially perpendicular to said post arm, and with said second end of said post arm lever pivotally attached to said second end of said linear actuator;

a hinge post including at least two hinges for supporting said gate and said gate opening device;

a stop post for arresting motion of said gate and maintaining said gate in a closed position;

a standoff comprising a longitudinal member having a first and a second end and rigidly attached at said first end to said hinge post at a point between said hinges, said standoff extending outward at an angle of approximately 147½ degrees from a plane formed by said gate when in a closed position;

a power supply comprising at least one DC battery and a solar cell to recharge said battery, said power supply for actuating said linear actuator;

a receiver means for receiving a radio signal from a remote transmitter and non-manually actuating said linear actuator;

a switch for manually activating said linear actuator;

key means for overriding said manual switch and thereby preventing the manual actuation of said linear actuator without said key means;

means to detach said gate arm from said gate thereby moving said gate without operation of said linear actuator;

wherein the combination of said standoff, said actuator link, said post arm lever, said gate arm lever, and said linear actuator moves said gate between a closed position when said gate is substantially across a roadway and against said stop post to an open position approximately 90° therefrom.

* * * * *